US005320193A

United States Patent [19]

Bongiovanni et al.

[11] Patent Number: 5,320,193

[45] Date of Patent: Jun. 14, 1994

[54] SAFETY ANCHOR

[75] Inventors: Nick Bongiovanni, Brampton; Vincent Cianfarani, Etobicoke, both of Canada

[73] Assignee: NVS Mechanical & Electronic Devises Ltd., Brampton, Canada

[21] Appl. No.: 19,706

[22] Filed: Feb. 19, 1993

[51] Int. Cl.[5] ..... A62B 35/02

[52] U.S. Cl. ..... 182/3; 182/45; 248/499; 248/237

[58] Field of Search ..... 182/3, 45; 248/499, 248/237; 52/37

[56] References Cited

U.S. PATENT DOCUMENTS

| | | | |
|---|---|---|---|
| 1,283,156 | 10/1918 | Green | 52/37 |
| 1,449,516 | 3/1923 | Kugler | 52/37 X |
| 3,887,967 | 6/1975 | Vandenbossche | 248/499 X |
| 4,090,314 | 5/1978 | Mason | 248/499 X |
| 4,425,982 | 1/1934 | Kibbie | 182/3 X |
| 5,011,106 | 4/1991 | Cody | 182/3 X |

*Primary Examiner*—Alvin C. Chin-Shue

*Attorney, Agent, or Firm*—Eugene J. A. Gierczak

[57] ABSTRACT

A safety anchor for the attachment of safety lines or supporting lines for suspended equipment, comprising a base plate adapted to be secured to a structure; a fastening wall projecting upwardly from said base plate, with a primary aperture fastening location adapted to receive a first line, and secondary aperture fastening location adapted to receive a second line.

14 Claims, 3 Drawing Sheets

SAFETY ANCHOR

FIELD OF INVENTION

This invention relates to a safety anchor, and more particularly relates to a safety anchor which permits the attachment of safety lines in fall arrest systems, or primary support lines of suspended equipment, and more particularly relates to an invention which is secured to a structure, permitting a safety line, or support line for suspended equipment to be attached to it for such purposes as window washing, cleaning or repairing of a building or its surface, and other related tasks on multistorey buildings.

BACKGROUND TO THE INVENTION

Various apparatus for securing safety lines and support lines for suspended equipment have heretofore been devised.

For example U.S. Pat. No. 4,932,185 (Lebel) discloses a window cleaners safety line anchor. In combination, the window cleaners safety line anchor is secured to the exterior of a roof structure and comprises a U shaped anchor member having a smoothly accurate inner side, a base for the anchor member with the U shaped member outstanding from the base in the end of the U shaped member fixed to the base to resist tensile forces to which the anchor is subjected in use in arresting the fall of a window cleaner, and the base having an aperture through it between the ends of the U shaped member. The tensile stud passes through the aperture in the base into the roof structure and secures the base to the roof structure and a supporting means spaces the base above the roof structure. Other variations of the window cleaners safety line anchor are disclosed including the addition of a compression member having an aperture through it and the use of a tensile stud having a bend along its length.

Furthermore, U.S. Pat. No. 3,860,098 (Huggett) discloses a safety rail apparatus in combination with a structure such as a building having a concrete wall portions with an elongated non-metallic tube embedded in the concrete wall of the structure adjacent to the outer face, defining an internal cavity which has a continuous longitudinal entrance slot into said cavity, thereby connecting each cavity. Inserted into the cavity is a block of slightly less dimension, however, wide enough to prevent the escape of a block member, so that it is slidably moveable through the slot. The individual operator would attach a safety harness to the block which allows movement of the block through the cavity, permitting the workperson to move parallel to the cavity, and offering support to arrest the fall of the workperson.

Moreover, U.S. Pat. No. 2,105,112 (Flower) discloses an insulator bracket which is adapted for attaching insulators to the brick or stone walls of a building for supporting electrical conduits, cables and the like.

Finally, U.S. Pat. No. 4,583,716 (Stephens et al.) discloses a universal anchor assembly for impact attenuation device, universal front anchoring system for reusable impact attenuation devices.

Each of the prior devices referred to above present structures having limited use as anchors mounted on multi-level storey buildings.

Further, the prior devices may not offer sufficient strength to make them capable of withstanding significant lateral and shear forces.

Further, some of the devices ref erred to above present structures which are not mobile, or easily installable on a preexisting building.

It is the object of this invention to provide a safety anchor with improved resistance against lateral and shear forces, which is portable, durable in construction, has a multitude of uses and thus greater efficiency, is easy to construct and will permit installation without the need for major reconstruction.

It is a further object of this invention to ensure the safety anchor is capable of withstanding lateral and shear forces in excess of the breaking strength of safety lines normally used in fall arrest systems and primary support lines for suspended equipment used in the washing and repairing of multi-level buildings.

Other objects and advantages will appear hereinafter. The broadest aspect of this invention relates to a safety anchor for the attachment of safety lines or supporting lines for suspended equipment, comprising a base plane adapted to be secured to a structure; a fastening wall projecting upwardly from said base plate with a primary aperture fastening location adapted to receive a first line, and two vertically aligned secondary aperture fastening locations adapted to receive a second line, the upper secondary aperture having its circumference set below the circumference of said primary aperture.

It is another aspect of this invention to provide a safety anchor for the attachment of safety lines or supporting lines for suspended equipment, comprising a base plate adapted to be secured to a structure; a fastening wall projecting upwardly from said base plate with a primary aperture fastening location adapted to receive a first line and two vertical aligned secondary aperture fastening locations adapted to receive a second line, said two vertically aligned secondary aperture fastening locations having a smooth inner surface, the upper secondary aperture having its circumference set below the circumference of the said primary aperture, lateral reinforcing supports located on opposite sides of said fastening wall and secured perpendicular to said fastening wall of said base plate, so as to increase the lateral stability of said safety anchor, said base plate presenting a flat surface having multiple apertures forming a configuration which aligns with said structure to which it is secured in order to receive a mounting means, said fastening wall having converging sides projecting upwardly from said base plate which merge with a curved edge.

It is another aspect of this invention to provide in combination, a safety anchor secured to a building structure, comprising a base plate adapted to be secured to said building structure; a fastening wall secured to and projecting upwardly from said base plate with a primary aperture fastening location adapted to receive a first line, and two vertically aligned secondary aperture fastening locations adapted to receive a second line; lateral reinforcing supports located on opposite sides of said fastening wall and secured perpendicular to said fastening wall and said base plate, so as to increase the lateral stability of said safety anchor; said base plate presenting a flat surface having multiple apertures forming a configuration which aligns with the building structure to which it is to be secured in order to receive a mounting means; said fastening wall having converging sides projecting upwardly from said base plate merging with a curved edge; said primary aperture fastening location having a smooth inner surface; said two vertically aligned secondary aperture fastening locations having a smooth inner surface, the upper secondary aperture having its circumference set below the circumference of the said primary aperture; each said independent lateral reinforcing support having the shape of a triangle.

It is yet another aspect of this invention to provide in combination, a safety anchor secured to a stationary structure, comprising a base plate adapted to be secured to said stationary structure; a fastening wall secured to and projecting upwardly from said base plate with a primary aperture fastening location adapted to receive a first line, and two vertically aligned secondary aperture fastening locations adapted to receive a second line; lateral reinforcing supports located on opposite sides of said fastening wall and secured perpendicular to said fastening wall and said base plate so as to increase the lateral stability of said safety anchor; said base plate presenting a flat surface having multiple apertures forming a configuration which aligns with the stationary structure to which it is to be secured in order to receive a mounting means; said fastening wall having converging sides projecting upwardly from said base plate merging with a curved edge; said primary aperture fastening location having a smooth inner surface; said two vertically aligned secondary aperture fastening locations having with a smooth inner surface, the upper secondary apertures having its circumference set below the circumference of the said central primary aperture; each said independence lateral reinforcing support having the shape of a triangle.

DESCRIPTION OF DRAWINGS

These and other objects and features shall now be described in relation to the following drawings in which.

DESCRIPTION OF THE INVENTION

Figure 1:
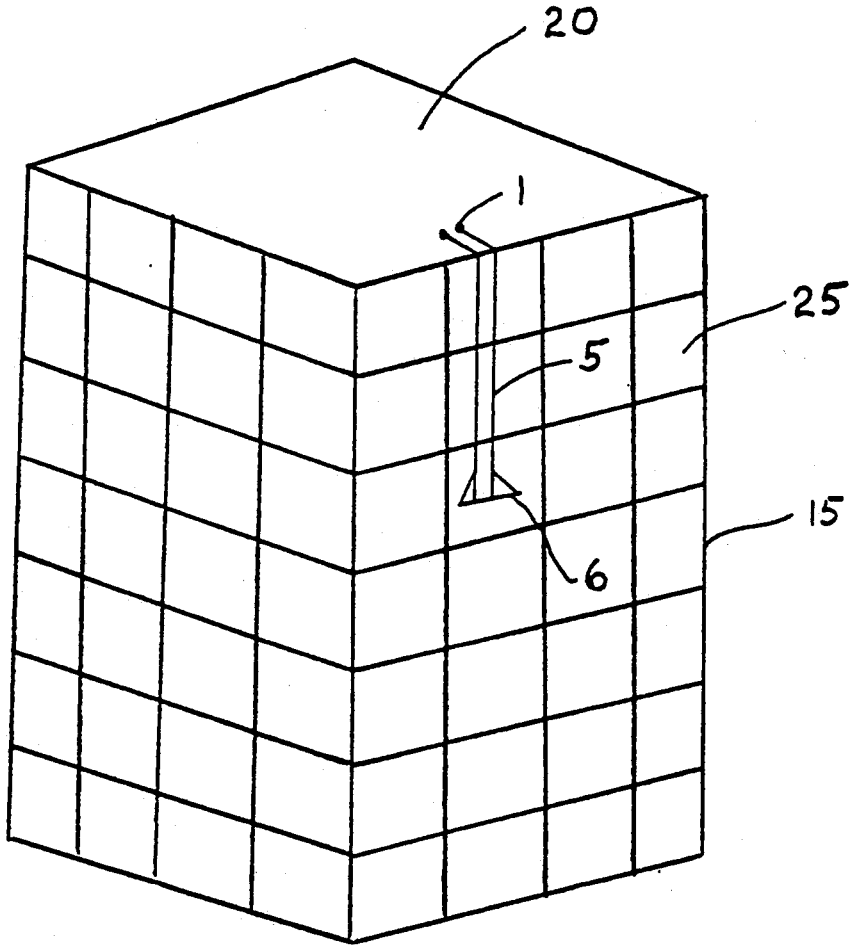
FIG. 1 is a perspective view showing use of the said safety anchor by workpersons cleaning or repairing the exterior windows of an office building.

Like parts shall be given identical numbers throughout the figures. The safety anchor is generally depicted by numeral 1 and comprises a base plate 10, a fastening wall 40 and lateral reinforcing supports 45 which are secured together in order that safety lines or support lines 5 for suspended equipment 6 can be attached. It is understood that the form of the invention herein described is to be taken as a preferred embodiment, and that certain changes in the shape, size and arrangement may be made without departing from the spirit of the invention.

Figure 2:
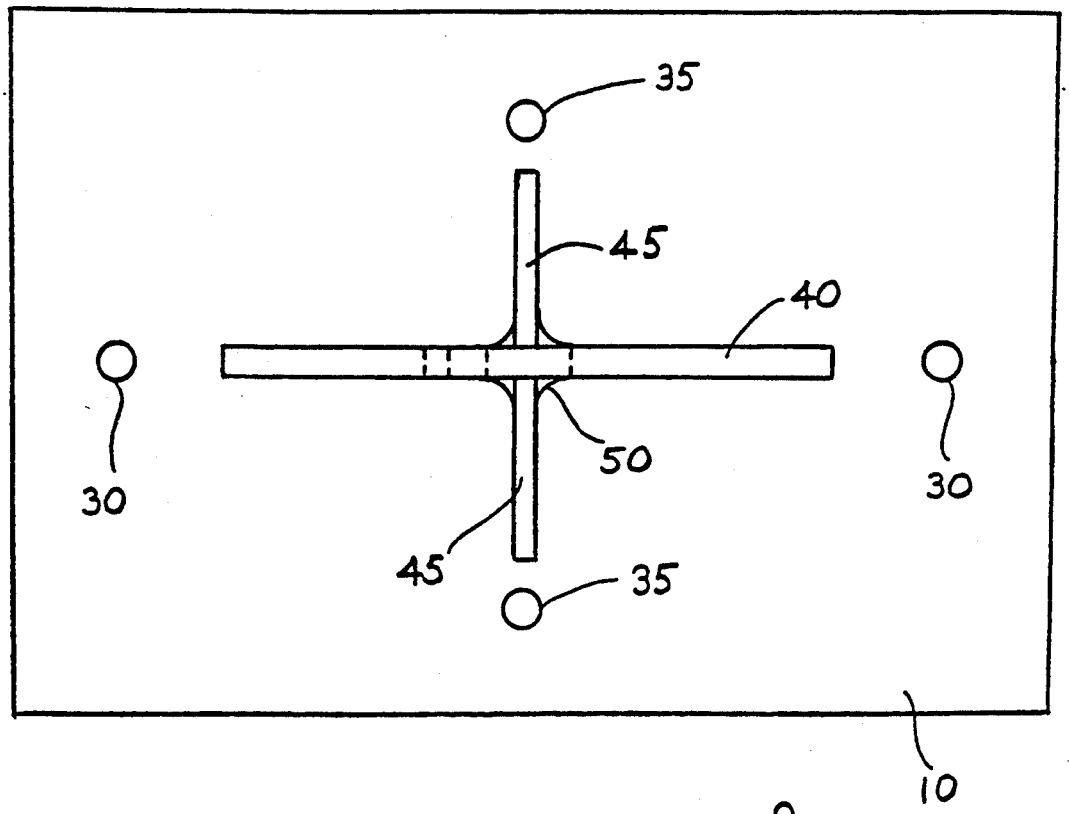
FIG. 2 is a top plan view of said safety anchor.

Referring now to FIG. 1, a safety anchor 1 is mounted or secured to a structure 20 of a building 15 more specifically the structure 20 as shown in FIG. 2 comprises a roof structure 20. However, it should be understood the structure could comprise another structure, including a building structure or a stationary structure. The safety anchor 1 is mounted or secured to a structure 20, in order to secure safety lines or support lines 5, for suspended equipment 6 in order to support or act as a safety mechanism for a window washer or repair person.

Referring now to FIG. 2 there is shown a flat rectangular base plate 10, having multiple mounting apertures 30, 35 which will be bore in the base plate 10 in a configuration which will align with the securing means installed in the roof structure 20. A preferred embodiment has mounting apertures 30, 35 located symmetrically along the axis defined by the adjoining of the fastening wall 40 and reinforcing laterals supports 45 to the face of the base plates 10, respectively. This aperture alignment will efficiently displace sheer lateral forces absorbed by the fastening wall 40 or reinforcing lateral supports 45 transferring the force through the base plate to the mounting means, likely a stud 70 and nut 80 to the structure 20. Failure to align the apertures on the identical axis to which the fastening wall 40 and reinforcing lateral supports 45 respectively are attached to the base plate will not affect the operation of the safety anchor 1, however, it will not transfer the forces from the safety anchor 1 to the structure 20 in as efficient manner. Furthermore, the symmetrical positioning of the mounting apertures 30, 35 along the identical axis as the fastening wall 40 and reinforcing laterals supports 45 are welded to the base pate 10 will result in the uniform securement of the safety anchor to the structure which will prevent the lateral movement of the safety anchor resulting in increased stability of the combination of the safety anchor 1 and roof structure 20.

Projecting upwardly from the face of the base plate is one fastening wall 40 and two lateral reinforcing supports 45. The fastening wall is welded to the face of the base plate 10, along the central horizontal axis of the base plate 10. The lateral reinforcing supports 45 are welded to the face of the base plate along the central vertical axis and perpendicularly along the central vertical axis of the fastening wall 40.

Figure 3:
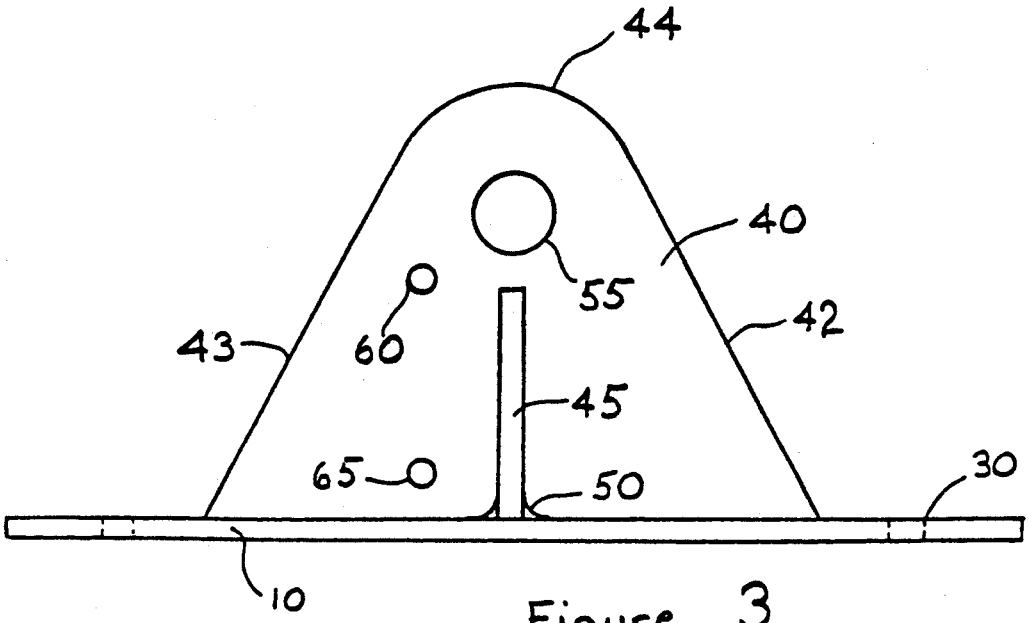
FIG. 3 is a side elevation view of the said safety anchor.

FIG. 3 illustrates the fastening wall 40, having converging side walls 42, 43 projecting upwardly from the face of the base plate 10 which merge with a curved edge 44 at a point before the side walls contact. The fastening wall 40 sides 42, 43 are smooth to prevent the incision or severing of lines 5. There is a primary fastening aperture 55 which has a smooth inner surface and is designed to receive lines 5 which will pass through the primary fastening aperture 55 and around the fastening wall 40 and be attached thereto. There are two vertically aligned secondary fastening apertures 60, 65. The upper secondary fastening aperture 60 having its circumference set at a level below the circumference of the primary fastening aperture 55. The secondary fastening aperture 60, 65 is narrower in radius than the primary fastening aperture 55, having a smooth inner surface and designed to receive lines 5 which will pass through the secondary fastening aperture 60, 65 and around the fastening wall 40 and be attached thereto. The opposite end of line which is fastened to the secondary fastening aperture 60, 65 will be attached at a point on the primary safety line or support line for suspended equipment 5, as an added safety feature thus in the event the primary safety line or support line of suspended equipment 5 is severed above the point of attachment of the secondary line it will support temporarily the load on the safety line or support line for suspended equipment.

Figure 4:
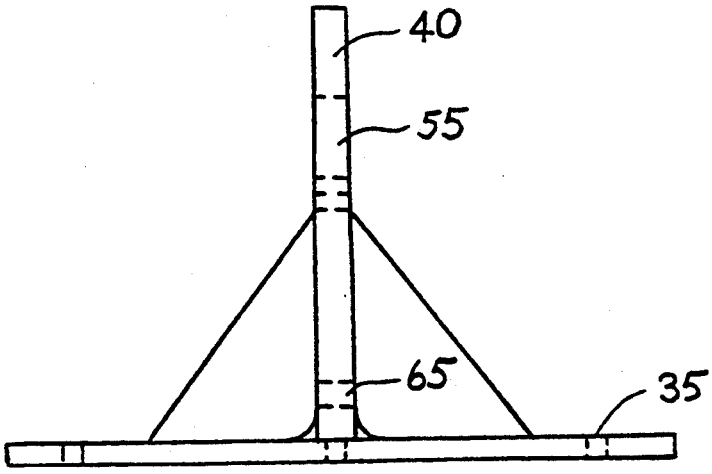
FIG. 4 is an end elevation of said safety anchor.

FIG. 4 illustrates two lateral reinforcing supports 45 having a triangular shape. The lateral reinforcing supports 45 are welded perpendicularly to the base plate 10 and the fastening wall 40 to create additional lateral stability for the fastening wall 40 which allows the safety anchor 1 to withstand greater lateral forces and to absorb greater shear forces.

Figure 5:
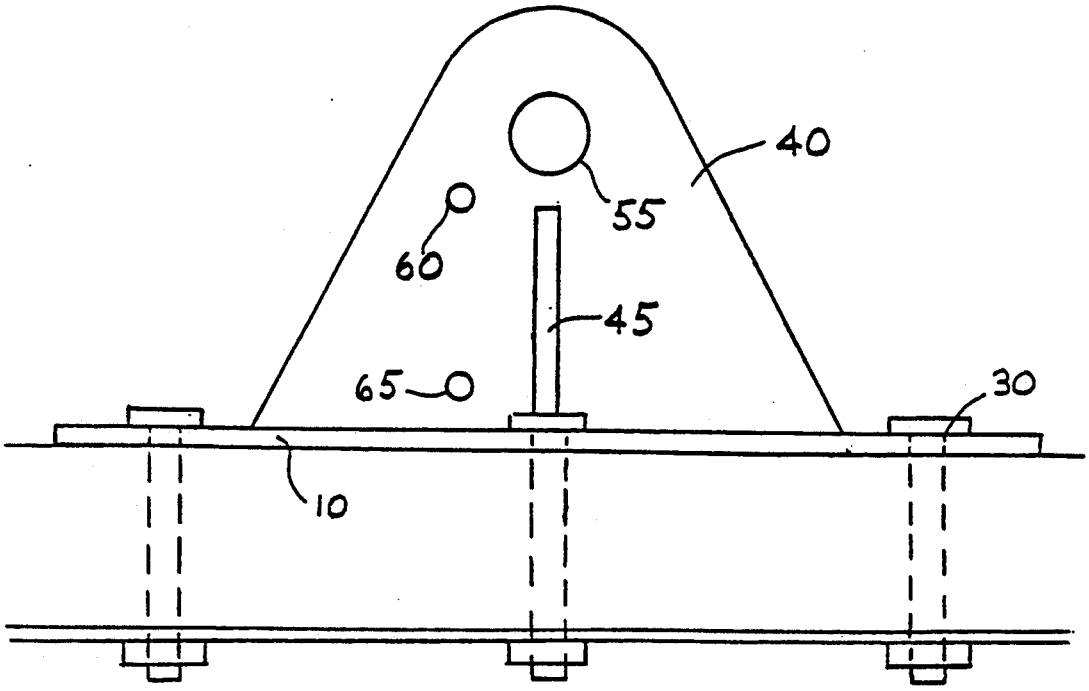
FIG. 5 is a side elevational view of said safety anchor attached to a structure.

FIG. 5 illustrates the preferred method of securing the safety anchor 1 to the structure 20. The mounting apertures 30, 35 are aligned with the configuration on the said structure 20 or stationary structure in order to receive the stud 70 to which a nut 80 is threaded and secured. The structure 20 should be composed of reinforced concrete slabs or structural steel making up part of the framework of the building. Another method of securing the safety anchor 1 is to encast in concrete walls said safety anchor 1.

Although the preferred embodiments as well as the operation and use have been specifically described in relation to the drawings, it should be understood that variations in preferred embodiment can be achieved by a person skilled in the art without departing from the spirit of the invention. It is therefore intended that the foregoing detailed description be regarded as illustrative rather than limiting and that it be understood that it is the following claims including all equivalents that are intended to define the scope of this invention. Accordingly, the invention should not be understood to be limited to the exact form revealed by the drawings.

The embodiments of the invention in which an exclusive property or privilege is claimed are defined as follows:

1. In a safety anchor for the attachment of safety lines or supporting lines for suspended equipment, comprising a base plate adapted to be secured to a structure; a fastening wall projecting upwardly from said base plate with a primary aperture fastening location adapted to receive a first line, and two vertically aligned secondary aperture fastening locations adapted to receive a second line, the upper secondary aperture having its circumference set below the circumference of said primary aperture.

2. In a safety anchor as claimed in claim 1 further including lateral reinforcing supports located on opposite sides of said fastening wall and secured perpendicular to said fastening wall and said base plate, so as to increase the lateral stability of said safety anchor.

3. In a safety anchor as claimed in claim 2 wherein the said base plate presenting a flat surface having multiple apertures forming a configuration which aligns with the structure to which it is to be secured in order to receive a mounting means.

4. In a safety anchor as claimed in claim 3 wherein the said fastening wall having converging sides projecting upwardly from said base plate which merge with a curved edge.

5. In a safety anchor as claimed in claim 4 wherein said primary aperture has a smooth inner surface.

6. In a safety anchor for the attachment of safety lines or supporting lines for suspended equipment, comprising a base plate adapted to be secured to a structure; a fastening wall projecting upwardly from said base plate with a primary aperture fastening location adapted to receive a first line and two vertically aligned secondary aperture fastening locations adapted to receive a second line, said two vertically aligned secondary aperture fastening locations having a smooth inner surface, the upper secondary aperture having its circumference set below the circumference of the said primary aperture, lateral reinforcing supports located on opposite sides of said fastening wall and secured perpendicular to said fastening wall of said base plate, so as to increase the lateral stability of said safety anchor, said base plate presenting a flat surface having multiple apertures forming a configuration which aligns with said structure to which it is secured in order to receive a mounting means, said fastening wall having converging sides projecting upwardly from said base plate which merge with a curved edge.

7. In a safety anchor as claimed in claim 6 wherein each of said independent lateral reinforcing supports has the shape of a triangle.

8. In a safety anchor as claimed in claim 7 wherein each of said independent lateral reinforcing supports has the shape of an isosceles triangle.

9. In combination, a safety anchor secured to a building structure, comprising a base plate adapted to be secured to said building structure; a fastening wall secured to and projecting upwardly from said base plate with a primary aperture fastening location adapted to receive a first line, and two vertically aligned secondary aperture fastening locations adapted to receive a second line; lateral reinforcing supports located on opposite sides of said fastening wall and secured perpendicular to said fastening wall and said base plate, so as to increase the lateral stability of said safety anchor; said base plate presenting a flat surface having multiple apertures forming a configuration which aligns with the building structure to which it is to be secured in order to receive a mounting means; said fastening wall having converging sides projecting upwardly from said base plate merging with a curved edge; said primary aperture fastening location having a smooth inner surface; said two vertically aligned secondary aperture fastening locations having a smooth inner surface, the upper secondary aperture having its circumference set below the circumference of the said primary aperture; each said independent lateral reinforcing support having the shape of a triangle.

10. In combination as claimed in claim 9 wherein studs pass through the apertures in the said base plate into the building structure securing the said safety anchor to the said building structure.

11. In combination as claimed in claim 9 wherein said safety anchor is secured to the roof structure, of said building structure comprising a base plate adapted to be secured to said roof structure; a fastening wall secured to and projecting upwardly from said base plate with said primary aperture fastening location adapted to receive a first line, and said vertically aligned secondary aperture fastening locations adapted to receive a second line; lateral reinforcing supports located on opposite sides of said fastening wall and secured perpendicular to said fastening wall and said base plate so as to increase the lateral stability of said safety anchor; said base plate presenting a flat surface having multiple apertures forming a configuration which aligns with the roof structure to which it is to be secured in order to receive a mounting means; said fastening wall having converging sides projecting upwardly from said base plate merging with a curved edge; said fastening wall having a central primary aperture with a smooth inner surface; said fastening wall having two vertically aligned secondary apertures with a smooth inner surface, the upper secondary aperture having its circumference set below the circumference of the said central primary aperture; each said independent lateral reinforcing support having the shape of a triangle.

12. In combination as claimed in claim 11 wherein studs pass through the apertures in the said base plate into the roof structure of said building structure securing the said safety anchor to the said roof structure.

13. In combination, a safety anchor secured to a stationary structure, comprising a base plate adapted to be secured to said stationary structure; a fastening wall secured to and projecting upwardly from said base plate with a primary aperture fastening location adapted to receive a first line, and two vertically aligned secondary aperture fastening locations adapted to receive a second line; lateral reinforcing supports located on opposite sides of said fastening wall and secured perpendicular to said fastening wall and said base plate so as to increase the lateral stability of said safety anchor; said base plate presenting a flat surface having multiple apertures forming a configuration which aligns with the stationary structure to which it is to be secured in order to receive a mounting means; said fastening wall having converging sides projecting upwardly from said base plate merging with a curved edge; said primary aperture fastening location having a smooth inner surface; said two vertically aligned secondary aperture fastening locations having with a smooth inner surface, the upper secondary aperture having its circumference set below the circumference of the said central primary aperture; each said independent lateral reinforcing support having the shape of a triangle.

14. In combination as claimed in claim 13 wherein studs pass through the apertures in the said base plate into the stationary structure securing the said safety anchor to the said stationary structure.

* * * * *